United States Patent [19]

Hill et al.

[11] 4,380,748

[45] Apr. 19, 1983

[54] BOBBINS FOR ELECTRICAL COILS

[76] Inventors: John Hill, 8 Westleigh Dr., Bickley, Kent; Royston W. Bannister, 11 Foalhurst Close, Tonbridge, Kent, both of England

[21] Appl. No.: 216,751

[22] Filed: Dec. 15, 1980

[30] Foreign Application Priority Data

Dec. 21, 1979 [GB] United Kingdom ..... 7944088

[51] Int. Cl.[3] ..... H01H 1/66

[52] U.S. Cl. ..... 335/151; 335/282; 336/208

[58] Field of Search ..... 335/282, 299, 151; 336/199, 205, 207, 208

[56] References Cited

U.S. PATENT DOCUMENTS 3,661,342 5/1972 Sears ..... 336/208 X 3,939,450 2/1976 Donnelly ..... 336/208 X

*Primary Examiner*—George Harris

*Attorney, Agent, or Firm*—Weingarten, Schurgin, Gagnebin & Hayes

[57] ABSTRACT

A bobbin for an electrical coil is described having a main winding space for electrical wire and at least two separate further winding spaces for terminating the wire wound on the main winding space. The or each further winding space has a groove in which a number of terminating wire coils can be wrapped. The groove is breached or gapped so that the wire coils wrapped in the channel bridge the breach and can be wholly or partially soldered together at the bridging portions to form terminal connections to the wire on the main winding space.

9 Claims, 4 Drawing Figures

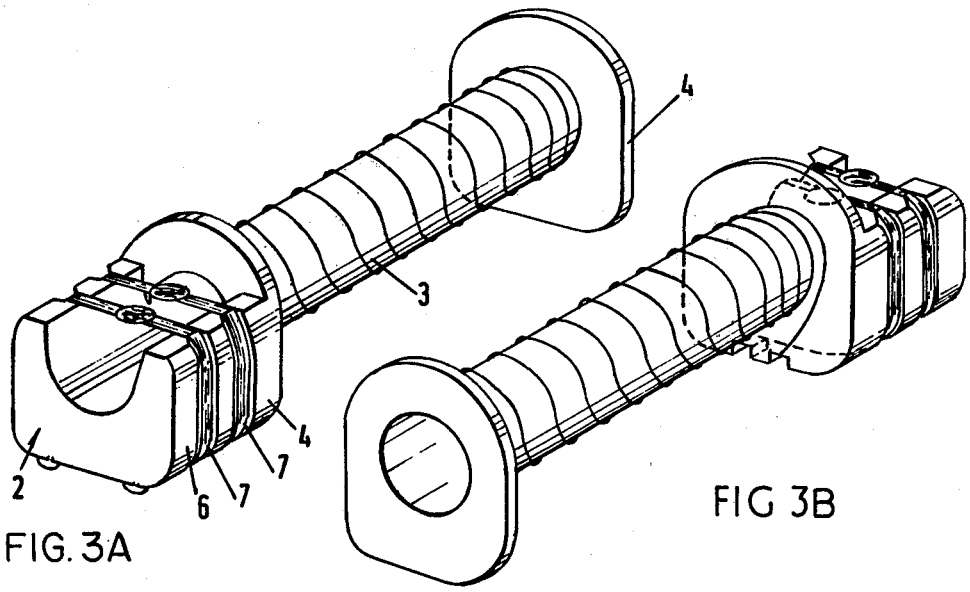
FIG. 3A
FIG 3B
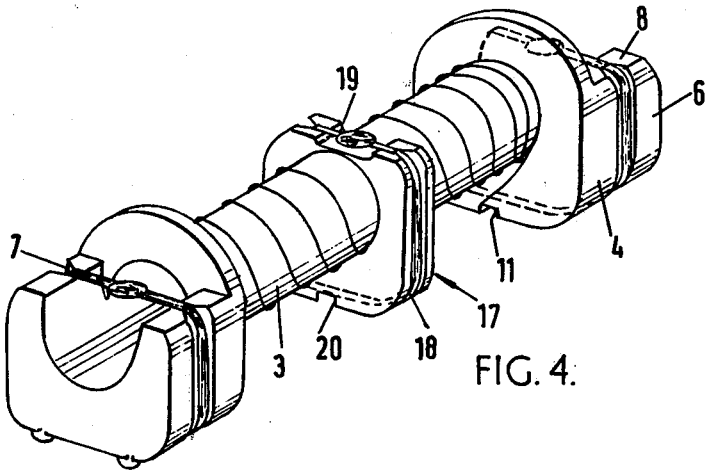
FIG. 4.

BOBBINS FOR ELECTRICAL COILS

TECHNICAL FIELD OF THE INVENTION

The present invention relates to bobbins for electrical coils.

BACKGROUND ART

A bobbin for an electrical coil is known comprising a tubular core with terminating flanges or cheeks at each end of the tubular core to define a main winding space of the bobbin.

The tubular core and the two end cheeks may be made of a plastics material and the end cheeks provided with metal posts.

During winding of the bobbin, electrical wire is wound a few turns around one post and then led through an opening in an adjacent cheek to the main winding space. When the required number of turns on the tubular core have been wound to form the main winding, the wire is led through a passageway in the other cheek and wound a few turns on the other post.

The wound turns on the posts are then anchored in place by soldering and the wire is severed at each post, to form respective terminal connections for the wire on the main winding.

Winding of the bobbins heretofore has involved manual handling, notably hand winding around the posts and soldering thereat to form the terminal connections. Apart from being tedious and time consuming, breakage of the wire is prevalent in these procedures, especially when handling miniature bobbins and winding wire of hair-like proportions sometimes of the order of 1/1000th of an inch in diameter.

A further problem with the known bobbins is that the terminal connections, which can be formed on them, have a structural weakness and are unsuitable in certain applications since they tend to break easily under stress, for example, in the manufacture of miniature reed relays for use in printed circuit boards.

The basic components of a well-known miniature reed relay comprise a reed switch surrounded by an energising electromagnetic coil wound on a bobbin of the type mentioned above.

To form the relay the terminal connections to the reed switch and coil are first soldered in place by hand at selected positions in a lead frame having connector pins normally corresponding in number to the terminal connections.

The lead frame is then inserted between two halves of a transfer mould and encapsulating material such as epoxy resin, is introduced into the mould under pressure to form a housing around the reed relay and its connections to the connector pins.

It is during mould encapsulation that the weakness of the terminal connections becomes apparent. Specifically they are unable to withstand adequately the pressures involved and breakage of the wire leading from the main winding to the bobbin posts is prevalent, this wire being but a single strand.

The above-mentioned problems with the prior art bobbin lead to excessive wastage, both from the standpoint of time and materials. Automated procedures would assist in obviating the former disadvantage and also in part the latter, but the basic structure of the bobbin does not lend itself to such a solution. Moreover the structural weakness of the terminal connections would still remain.

DISCLOSURE OF THE INVENTION

Accordingly it is an object of the invention to provide a bobbin for an electrical coil on which it is possible to form terminal connections for the coil, of improved strength over the prior art.

It is also an object of the invention to provide a bobbin for an electrical coil on which strong terminal connections for the coil can be formed by automated procedures.

Further it is an object of the invention to provide a bobbin for an electrical coil on which strong terminal connections can be formed by automated procedures in such a way that the wound bobbin can be directly connected into a lead frame for forming a reed relay, by automated techniques, and in which the terminal connections withstand the pressures during mould encapsulation of the relay.

According to the invention there is provided a bobbin of unitary construction comprising a main winding space for winding electrical wire, at least one further winding space separate from the main winding space for terminating the wire wound on said main winding space, a passage for wire between the main and the or each further winding space, the or each further winding space having an annular channel or groove in which a number of terminating coils of wire can be wound during coiling of the bobbin, and a breach in the channel or groove which is bridged by said terminating coils to form accessible positions whereat the terminating wire coil can be wholly or partially joined together to form terminal connections to the wire on the main winding space.

The advantage of this arrangement according to the invention is that strong terminal connections can be formed on the further winding spaces, in contrast to the prior art employing winding-off posts.

Moreover due to its unitary construction breakage of parts, prevalent in the prior art, is much reduced and the bobbin structure lends itself more readily to coiling by automated techniques.

The accessible nature of the terminal connections which can be formed on the bobbin, render the bobbin directly connectable into a lead frame for forming a reed relay, the tough terminal connections being able to withstand the pressures involved in encapsulating the relay in plastics.

Other features and advantages of the invention will become apparent from the description that follows.

BRIEF DESCRIPTION OF THE DRAWINGS

An embodiment of the invention will now be described by way of example with reference to the accompanying drawings wherein:

FIG. 3 is a perspective view of a bobbin according to another embodiment of the invention; and FIG. 4 is a perspective view of the embodiment of FIG. 1 and provided with a centre tap terminal connection.

BEST MODE OF CARRYING OUT THE INVENTION

Figure 1:
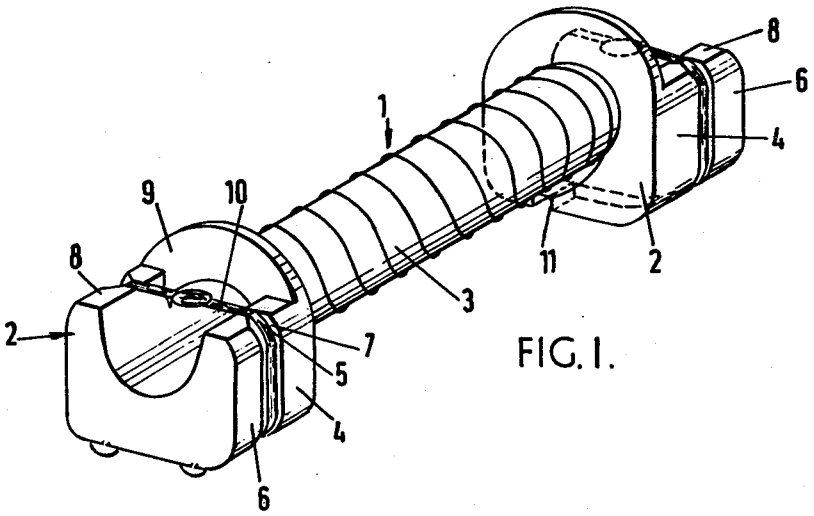
FIG. 1 is a perspective view of a bobbin according to an embodiment of the invention, the bobbin being shown wound with electrical wire.

The bobbin shown in FIG. 1, wound with electrical wire, is a one piece moulding of plastics material and has a main winding space 1 and two further winding spaces coaxial therewith. The winding space 1 has a main tubular winding core 3 and end cheeks 4 which define between them the main winding space 1 of the bobbin.

The winding spaces 2 have a central tubular winding core 5 delimited respectively by the end cheeks 4 of the winding space 1 and end cheeks 6 which form the ends of the bobbin. The winding core 5 forms the base of a notched annular groove 7.

As will be seen from FIG. 1 a cut-out 8 is formed in the winding spaces 2. The cut-out 8 is made by effecting a flat axial cut in the end faces of the cheeks 6, the axial cut extending to the central plane of the cheek 4 to form an abutment face 9. The position of the cut is such as to expose the hollow core of the winding spaces 2.

The cut-outs 8 form breaches or gaps in the groove 7 of the further winding spaces 2.

During winding of the bobbin with electrical wire, a few turns are initially wound on the winding core 5 of one of the winding spaces 2 as shown. The wire is then led to the main winding core normally through openings 11 in the cheeks 4. Once the winding core 3 has been filled with a required number of turns, the wire is led off to the other winding spaces 2, the winding core 5 of which is then wound with a number of turns as shown.

The breaches in the winding spaces 2, formed by the cut-outs 8, are bridged by the wire wound around the winding cores 5 to form unsupported bridging portions 10. The wire can then be terminated at the bridging portions 10 and soldered to one or more of the other strands thereat to form terminal connections for the wire wound on the winding core 3.

The soldering itself softens the insulation normally present on the wire so that the strands wound around the winding spaces 2 are either partially or wholly joined together. Deleterious effects on the material of the bobbin during soldering however are avoided due to the breaches introduced by the cut-outs 8, and the consequent spacing of the bridging portions 10 from the material of the bobbin.

The soldering bridging portions forming the terminal connections are composed of several strands of wire according to requirements thus introducing strength at the critical point. Thus it will be seen that the provision of the further winding spaces 2 as constructed, enables the formation of tough and strong terminal connections for the coil on the main winding space 1.

Moreover the arrangement means that the the terminals can be wound and soldered by automated procedures, and the exposed accessible nature of the connections can be made use of to render the bobbin suitable for easy connection in a lead frame also by automated techniques. In short overall individual handling of parts is avoided, obviating damage, slow production and economic inefficiency.

To illustrate the advantages of the bobbin as hereinbefore described, an application of its use in the manufacture of miniature reed relays will now be described with reference to FIG. 2.

Figure 2:
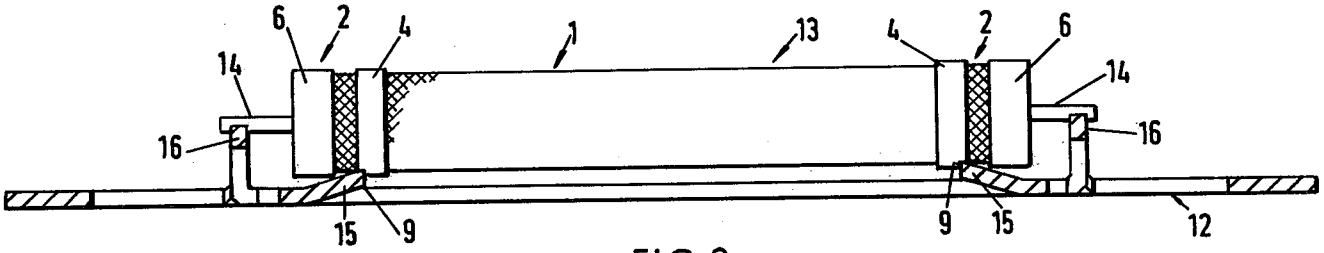
FIG. 2 shows a reed switch mounted within the wound bobbin of FIG. 1, and positioned on a relay lead frame.

The wound bobbin illustrated in FIG. 1, is shown at 13 in FIG. 2, positioned in a lead frame 12.

A reed switch is mounted within the bobbin and has lead-in terminals 14 which project axially of the bobbin. It will be appreciated by those skilled in the art that when the coil of the bobbin is energised this will actuate the reed switch.

The construction of the bobbin facilitates ease of mounting to the lead frame 12 by automated techniques. Thus the bridging portions 10 may be positioned to rest on upturned tags 15 of the frame, and the terminal leads 14 of the reed switch on upturned tags 16 of the frame 12. The spacing between the tags 15 is such that the flat faces 9 of the winding spaces 2 respectively abut the tags 15 and positionally stabilize the reed relay while connections to tags 15 and 16 are quickly made by automated soldering techniques. Alternatively the connections could be made by welding.

The efficacy of the bobbin construction as described with reference to FIG. 1, will be apparent first in that winding of the bobbin can be carried out entirely by automation to produce strong terminal connections, and second the thus wound bobbin can be easily and readily positioned and connected to a lead frame also entirely on an automated basis.

Other configurations of bobbin will be apparent to those skilled in the art without departing from the scope of the invention as defined in the appended claims.

For example, the winding spaces 2 could have one or more sectored cut-outs across the longitudinal width thereof with the bases of the cut-outs lying axially of the bobbin thus providing breaks in the winding run around the winding core 5. Such cut-outs would not necessarily expose the hollow core of the bobbin according to the embodiment of FIG. 1. The sectored cut-outs however, as before, would form the required bridging portions in the wire run and provide accessible terminal connections for attachment to a lead frame.

Moreover the bobbin could be constructed to provide a further winding space at one end only of the main winding space. This is illustrated in FIG. 3. In this case the further winding space 2 has a pair of spaced grooves 7 for terminating the respective ends of the wire on the main winding space 1. Other features of this embodiment are similar to the FIG. 1 embodiment and need not be further described. The features which do correspond have been assigned the same reference numerals.

The embodiment shown in FIG. 4 is the same as that of FIG. 1 with the addition of a winding former 17 positioned midway on the main winding space 1.

The former 17 is constituted by a thick flange formed on the main winding core 3. The periphery of the flange is provided with an annular groove 18. The flange has a transverse notch 19 in its periphery breaching the groove 18 and slots 20 in the respective peripheral walls of the groove 18, one of which is not shown.

During coiling of the main winding space of the bobbin, from left to right in relation to the drawing, wire is led off through (shown) slot 20 and a number of turns are wound around the annular groove 18. The wire is then led off the former 17 through the other (not shown) slot 20 and coiling of the main winding core continues.

The wire wound on the former 17 bridges the gap or breach formed by the notch 19 to provide accessible positions for forming a terminal connection by soldering the wire coils thereat either partially or wholly together similarly to the windings formed in the grooves 7 on the winding spaces 2.

It will be appreciated in this way that the former 17 provides means for forming a readily accessible centre tap for the coiled bobbin.

Further modifications of the invention will be readily apparent to those skilled in the art, such modifications being within the scope of the invention as defined in the following claims.

We claim:

1. A reed relay assembly, comprising:

a bobbin having a hollow interior;

first and second spaced apart flanges integrally formed on said bobbin for defining therebetween a first main winding space, at least one of said flanges having at least one slot for defining a wire passageway;

third and fourth flanges integrally formed on said bobbin and axially spaced from said first and said second flanges for defining a second and a third annular termination winding space;

a selected length of electrical wire wrapped a preselected number of turns around said first winding space to provide a main coil and wrapped a preselected number of turns around said second and said third annular termination winding spaces to provide termination windings the individual turns of which are electrically joined together to provide first and second electrical terminals for said main coil; and a reed switch disposed through said hollow interior and within said main coil.

2. The reed relay assembly of claim 1, wherein each of said third and fourth flanges are outwardly axially spaced from respective ones of said first and said second flanges and define said second and said third annular termination winding spaces respectively between said first and said third flanges and between said second and said fourth flanges, and wherein both of said first and said second flanges are provided with a slot.

3. The reed relay assembly of claim 1, wherein said third and said fourth spaced apart flanges are both axially spaced apart outwardly to one side of one of said first and said second flanges, and wherein said second annular termination winding space is formed between said fourth and said third flange, and said third annular termination winding space is defined between said one of said first and said second flanges and said third flange, and wherein said one of said first and said second flanges is provided with two spaced apart slots.

4. The reed relay assembly of claim 1 further including a fifth flange integral with said bobbin intermediate said first and said second flanges and having a fourth annular termination winding space whereon said wire is wrapped a preselected number of turns and the individual turns thereof are joined together electrically for providing a tap for said main coil.

5. The reed relay assembly of claim 2, wherein said third and said fourth flanges are truncated such that said annular termination winding spaces are in communication with said hollow interior.

6. The reed relay assembly of claim 3, wherein said third and said fourth flanges are truncated such that said annular termination winding spaces are in communication with said hollow interior.

7. The reed relay assembly of claim 1, further including a lead frame having a first pair of terminals adapted to electrically contact respective ones of said first and said second electrical terminals of the main coil, and a second pair of terminals adapted to electrically contact respective terminals of said reed switch.

8. The reed relay assembly of claim 1, further including a plastic material encapsulating said reed relay assembly.

9. A bobbin for an electrical coil, comprising:

a bobbin having a hollow interior;

first and second spaced apart flanges integrally formed on said bobbin for defining therebetween a first main winding space, at least one of said flanges having at least one slot for defining a wire passageway;

third and fourth flanges integrally formed on said bobbin and axially spaced from said first and said second flanges for defining a second and a third annular termination winding space;

a selected length of electrical wire wrapped a preselected number of turns around said first winding space to provide a main coil and wrapped a preselected number of turns around said second and said third annular termination winding spaces to provide termination windings the individual turns of which are electrically joined together to provide first and second electrical terminals for said main coil.

* * * * *